US009695807B2

(12) United States Patent
Kloss et al.

(10) Patent No.: US 9,695,807 B2
(45) Date of Patent: Jul. 4, 2017

(54) GAS MICROPUMP

(75) Inventors: Yury Yrevich Kloss, Moscow (RU); Feliks Gregorevich Cheremisin, Moscow (RU); Denis Vladimirovich Martynov, Moskovskaya obl. (RU)

(73) Assignees: Moscow Institute of Physics and Technology State University (Moscow Institute of Physics and Technology, MIPT), Moscow (RU); Federal State Budgetary Institution, Federal Agency for Legal Protection of Military, Special and Dual Use Intellectual Activity Results (FSBI-FALPIAR), Moscow (RU)

( * ) Notice: Subject to any disclaimer, the term of this patent is extended or adjusted under 35 U.S.C. 154(b) by 619 days.

(21) Appl. No.: 14/112,008

(22) PCT Filed: Feb. 13, 2012

(86) PCT No.: PCT/RU2012/000097

§ 371 (c)(1),
(2), (4) Date: Oct. 15, 2013

(87) PCT Pub. No.: WO2012/144932

PCT Pub. Date: Oct. 26, 2012

(65) Prior Publication Data

US 2014/0037468 A1 Feb. 6, 2014

(30) Foreign Application Priority Data

Apr. 19, 2011 (RU) ..... 2011115343

(51) Int. Cl.

| | |
|---|---|
| ***F04B 19/24*** | (2006.01) |
| ***F04B 37/06*** | (2006.01) |
| ***F04B 19/00*** | (2006.01) |

(52) U.S. Cl.
CPC ..... *F04B 19/24* (2013.01); *F04B 19/006* (2013.01); *F04B 37/06* (2013.01)

(58) Field of Classification Search
CPC ..... F04B 19/24; F04B 19/006; F04B 37/06
See application file for complete search history.

(56) References Cited

U.S. PATENT DOCUMENTS 3,565,551 A * 2/1971 Hobson ..... F04B 37/02 417/207
5,839,383 A * 11/1998 Stenning ..... B63B 25/14 114/72

(Continued)

FOREIGN PATENT DOCUMENTS

JP 5280465 A 1/1993

*Primary Examiner* — Peter J Bertheaud
*Assistant Examiner* — Dnyanesh Kasture
(74) *Attorney, Agent, or Firm* — Andrew W. Chu; Craft Chu PLLC

(57) ABSTRACT

The micropump includes continuous cylindrical separating pipes having at least two alternating stages of pipes of small radius and large radius connected in succession. Each pipe of a large radius has one end as a hot zone, and the opposite end as a cold zone. The pipes alternate straight pipes with a large radius and U-shaped curved pipes with a small radius. The relationship of the large radius (R) to the small radius (r) is in a range of R/r=2 to 10000, while the relationship of the temperature ($T_2$) of a hot zone to the temperature ($T_1$) of a cold zone is $T_2/T_1$=1.1 to 3.0. The length and radius measurements of a straight pipe and a U-shaped pipe ensure a given change in temperature of the gas from the temperature of the hot zone to the temperature of the cold zone.

5 Claims, 7 Drawing Sheets

(56) References Cited

U.S. PATENT DOCUMENTS

| | | | | |
|---|---|---|---|---|
| 5,871,336 | A * | 2/1999 | Young | F04B 37/06 417/207 |
| 6,533,554 | B1 * | 3/2003 | Vargo | F04B 19/006 417/207 |
| 2005/0095143 | A1 | 5/2005 | Bernard et al. | |
| 2008/0178658 | A1 | 7/2008 | Muntz et al. | |

* cited by examiner

Adjoining tetrahedrons

Adjoining with the wall tetrahedron

GAS MICROPUMP

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates to the field of molecular gas pumps and may be used for pumping a gas out of microdevices or in analytical microsystems intended for analyzing small volumes of gases, when mechanical movement of a gas becomes inefficient, as well as may be applicable for filtering gases. Also, the invention may be used in the field of indication and express analysis of air for the presence of substances of various kinds, including poisonous substances, chemically dangerous substances, potent toxic substances, as well as may be related to medical equipment, in particular to apparatuses for artificial pulmonary ventilation.

Pumps are used for pumping a gas out of devices which operation requires low vacuum (760 Torr-1 mTorr), high vacuum (1 mTorr-$10^{-7}$ Torr) or ultrahigh vacuum ($10^{-7}$ Torr-$10^{-11}$ Torr). Examples of such devices are mass spectrometers, optical spectrometers, optical electronic devices. Another application for pumps is sampling of a gas from the environment for the purpose of analyzing it in gas detectors and sensors.

2. Description of Related Art Including Information Disclosed Under 37 CFR 1.97 and 37 CFR 1.98.

Now a trend exists that is directed to reducing instrument dimensions for the purpose of decreasing power consumption, dimensions and weight of devices as well as adapting them for use in microelectromechanical systems (MEMS). Attempts to decrease sizes of existing commonly used mechanical pumps face big problems due to the presence of moving parts in pump designs. A few pump types that exist in a reduced scale now, such as mesoscale pumps and micropumps, exhibit, as a rule, insufficient efficiency and limited applicability, and damage systems with destroying shocks.

One alternative solution is to integrate thermal pumps having no moving mechanical parts and operating due to the effect of gas thermal sliding along non-uniformly heated walls. The claimed device maintains a temperature gradient due to which a directed gas flow is formed during the operation process.

The analogous solution for the claimed device is the classic Knudsen pump consisting of straight, successively connected, cylindrical pipes of small and large radii. Diameters of all pipes of a small radius are similar and many times less than diameters of pipes of a large radius. Thus, the classic Knudsen pump is a periodic structure which period is formed by a pipe of a small radius and a pipe of a large radius that are connected in succession. Temperature distribution is periodical and has the same period, linearly increasing from $T_1$ to $T_2$ along the pipe of a small radius and linearly decreasing from $T_2$ to $T_1$ along the pipe of a large radius. Known technical solutions (U.S. Pat. No. 6,533,554 and US 2008/0178658) present modern implementations of a microscopic Knudsen pump that comprises two thermal baffles having holes for a gas flow, a porous material and a heater. The porous material is an analogue of pipes of a small radius in the classic Knudsen pump. The heater provides for required temperature distribution creating the effect of gas thermal sliding along the walls.

When gas pressures are lower than 0.1 Torr, a length of the gas molecule free run becomes greater than diameters of micropipes; therefore, it is necessary that a pump can be efficiently operated in the free molecular mode formed both in the pipe of a small radius and in the pipe of a large radius. The principal disadvantage of the classic Knudsen pump is that it is insufficiently efficient in this mode. Due to the fact that the pipe shapes are similar, a small pressure relationship is created only on account of different length-diameter ratios of the pipe of a small radius and the pipe of a large radius.

Modern analogues of the classic Knudsen pump are designed in such a way that the free molecular mode exists in pipes of a small radius and the continuous mode exists in pipes of a large radius, i.e., the Knudsen number in pipes of a large radius should be $Kn \leq 0.01$. In order to operate a pump at pressures lower than 0.1 Torr, it is necessary to create large-radius pipes of a great diameter which increases pump dimensions significantly and makes it unsuitable for pumping microvolumes of a gas. For example, when the Knudsen number at temperature T=300K is 10 in a small-radius pipe and 0.01 in a large-radius pipe and when a pump may transfer a gas at the pressure of 0.1 Torr, the diameter of large-radius pipes should be 38 mm and at the pressure of 0.01 Torr, it should be equal to 38 cm. Modern designs of pumps use pipes having a diameter not more than 50 microns, which does not enable to efficiently use them at pressures of 0.1 Torr or lower.

SUMMARY OF THE INVENTION

This invention is based on the task of providing a gas micropump that increases efficiency and reduces dimensions of a pump operating on account of the thermal sliding effect by changing shapes and relative dimensions of structural members, and, thus, improving its performance.

In order to solve the task and achieve the technical effect, the gas micropump comprises continuous cylindrical separating pipes consisting at least of two alternating stages of small-radius and large-radius pipes connected in succession, wherein one end of the pipes is the hot zone and the opposite one is the cold zone. According to the claimed device, the pump is made of alternating straight pipes of a large radius R and U-shaped curved pipes of a small radius r, and the micropump can be operated in an optimal mode at the following parameter ratios: the relationship of the large radius R of a straight pipe to the small radius r of an U-shaped pipe is in the value range of R/r=2 to 10000, while the relationship of the temperature $T_2$ in the hot zone to the temperature $T_1$ of the cold zone is $T_2/T_1$=1.1 to 3.0, the length and radius values for the straight pipe and the U-shaped pipe being selected so as to ensure the said change in gas temperature from the hot zone temperature to the cold zone temperature.

Additional embodiments of the device are possible, wherein:

- the hot zone and the cold zone are silicon chips of cylindrical shape, having a similar radius of the large-radius pipe;
- the surface of the hot-zone silicon chip comprises a golden film.

The claimed device enables to eliminate the principal disadvantage of the classic pump, namely, low efficiency during operation in the free molecular mode created in the small-radius and large-radius pipes.

The proposed invention generates the pumping effect due to a directed gas flow in microscale devices in a broad range of the Knudsen number in the U-shaped small-radius cylindrical pipe and the straight large-radius cylindrical pipe. A gas flow appears in the border area due to a gas sliding along a temperature gradient imparted to the wall by a heater arranged at the pipe joint. Due to the fact that a temperature gradient is imparted both to the U-shaped small-radius pipe and to the large-radius pipe, oppositely directed gas flows are created at the border areas of both pipes. A flow created in the U-shaped pipe is greater than a flow in the straight pipe. In the result of this physical phenomenon a gas pressure ratio is created in the pump ends, this ratio being greater than that created in the ends of the classic pump at the same temperature distribution. The technical effect (an increase in gas pumping efficiency as compared to the classic pump) is achieved due to the introduction of the U-shaped pipe into the design of the proposed invention. Owing to the substitution of U-shaped pipes for straight pipes, the pump becomes flexible, which enables to create its compact implementations.

The above advantages as well as the features of this invention will be explained below with its best embodiment with reference to the accompanying drawings.

DETAILED DESCRIPTION OF THE DRAWINGS

Figure 1:
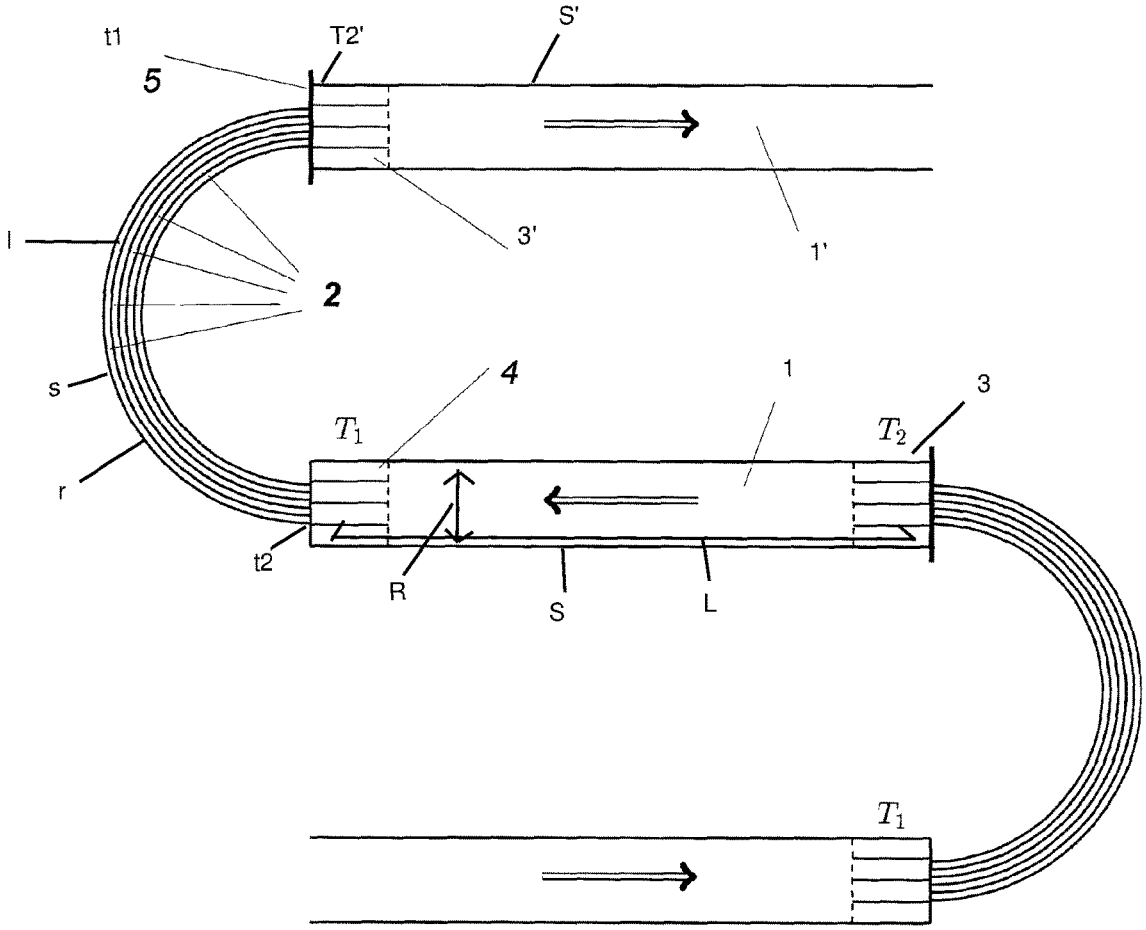
FIG. 1 is a schematic view, showing a possible embodiment of the gas micropump design according to this invention. The U-shaped curved pipes are successively connected to the large-radius pipes, each second joint comprise a hot zone (is heated).

The claimed gas micropump (FIG. 1) comprises a large-radius cylindrical pipe 1 made straight, a small-radius cylindrical pipe 2 made U-shaped and connected to the cylindrical pipe 1, a hot zone 3 (silicon chip), a cold zone 4 (silicon chip), a golden film 5 to which a voltage is applied for the purpose of creating hot and cold temperature zones. The micropump can comprise a plurality of continuous cylindrical separating pipe units being connected in series so as to form a continuous passage for flow of gas through the pipe units. Each pipe unit is comprised of a first pipe 1, having a first pipe body with a first radius R and a first length L, the first pipe body having a first outer surface S, a first inlet end T2 and a first outlet end T1, and a second pipe 2, having a second pipe body with a second radius r and a second length l, the second pipe body having a second outer surface s, a second inlet end t2, and a second outlet end t1. The first pipe 1 being straight and cylindrical, and the second pipe 2 is curved in a U-shape and cylindrical. The first inlet end T2 has an inlet end temperature in a hot zone 3 formed by a heater. The first outlet end T1 has an outlet end temperature in a cold zone 4 formed by a cooler. The pipe units alternate from first pipes to second pipes.

The large-radius pipes 1 may be made of a porous material having heat conductivity not more than 0.1 W/mK which pores have the diameter of 30 microns when the pipe length is 300 microns. A diameter and a length of the large-radius pipes 1 are selected in such a way that a gas may be cooled from a heater 3 temperature (hot zone) to a cold zone 4 temperature (e.g., temperature of the environment). An aerogel material having pores of appropriate size or filled with glass or ceramic balls, as create pores with a size equal to approximately 0.2 of their size, may be used for implementing large-radius pipes 1.

U-shaped small-radius pipes 2 may be made of an aerogel porous material. This material (of a pipe 2) has an average pore diameter of 20 nanometers and a very low heat conductivity (0.017 W/mK), which ensures a stable temperature gradient and thermal sliding of a gas along pore walls. The length of a U-shaped pipe 2 is 150 microns, its width is 20 microns, its curvature radius is 48 microns.

Heating and cooling of a gas is ensured by silicon chips with the length of 30 microns which have holes with a diameter of approximately 5 microns. Silicon exhibits high heat conductivity (150 W/mK) which enables to maintain constant (similar) temperature along the chip. Geometric dimensions of holes are selected so as a gas passing through holes in the chips may take a chip temperature. Holes in silicon chips may be made by MEMS standard methods by way of selective removal of the material.

A silicon chip in each second joint of the pipes 1 and 2 contains a thin golden film 5 (shown by bold line in FIG. 1) that is heated (hot zone 3) by action of electric current. Instead of a golden film, other materials available in the industry may be used for creating a temperature gradient. For example, it is possible to create a suitable temperature mode by irradiating the walls. A heater may be replaced by cooling devices intended for lowering a cold zone temperature (cold zone 4) relative to the environment.

The proposed device is hermetically connected to be pumped in or out reservoirs. A directed gas flow in the claimed pump appears on account of the effect of gas thermal sliding along the walls with a temperature gradient created by heaters 3 or coolers 4. In the result, a gas from a pumped out reservoir or device flows into the pump through the first-stage pipe and exits the pump into a pumped in reservoir or the environment through the second pipe of the last stage. Thus, a directed gas flow successively passes the stages of U-shaped large-radius and small-radius pipes through the temperature zones 3 and 4.

Figure 6:
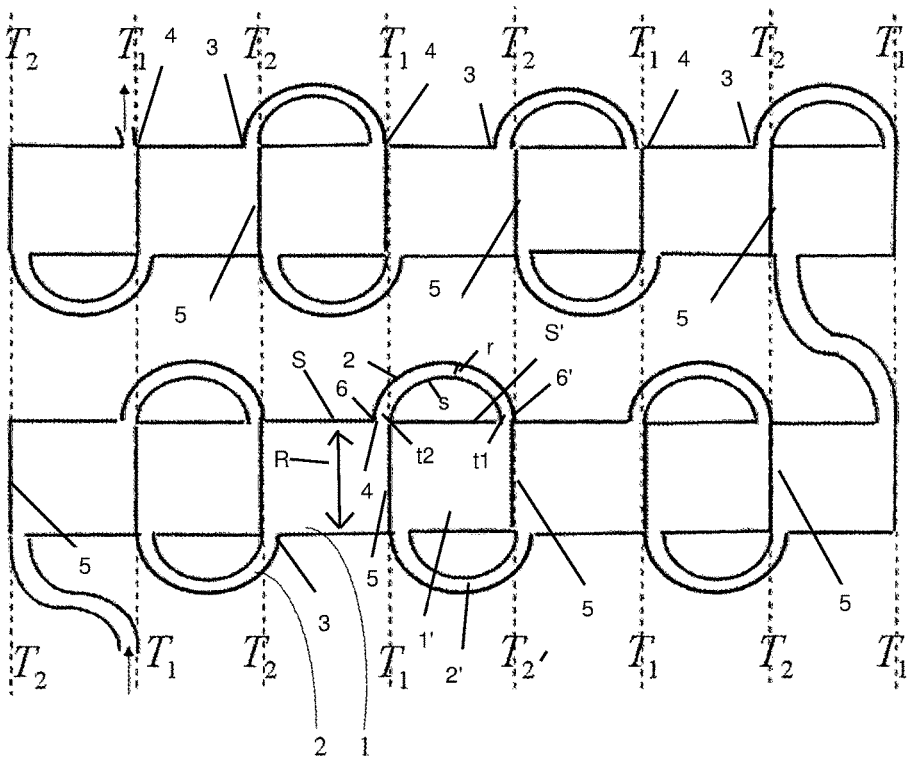
FIG. 6 shows a schematic view of possible embodiment of the proposed pump. Straight large-radius pipes are made on account of introducing impermeable baffles into a longer pipe. U-shaped small-radius pipes are arranged laterally to the large-radius pipes.

Pumps providing for significant pressure ratios should consist of several stages of successively connected U-shaped small-radius pipes 2 and large-radius straight pipes 1. Embodiments of such constructions are shown in FIG. 1 and FIG. 6.

SPECIFIC EMBODIMENTS OF THE INVENTION

Due to flexibility of the proposed pump, it may depend on a field of application. Some of possible examples of particular making of a combined pump are described below.

1) Unlike the linear classic design (analogous solutions), the large-radius pipes 1 may be arranged in a way shown in FIG. 1. They are connected by several U-shaped small-radius pipes 2. A temperature gradient is applied along each of the pipes, which gradient is created by heaters (golden films 5 in the form of plates with a voltage supplied thereto). They are arranged in close proximity to silicon chips with greater heat conductivity, which enables to heat a gas to a required temperature.

2) The large-radius pipes 1 may be joined into one pipe with baffles (FIG. 6), each second of the latter being heated, and the U-shaped small-radius pipes 2 may be arranged on the side surfaces of the large-radius pipes 1. By rearranging the small-radius pipes, it is possible to shift the large-radius pipes 1 to other surface areas of the large-radius pipes, in order the pump is not too long. A diagram of such a pump is shown in FIG. 6. A temperature gradient $T_2>T_1$ is applied along each pipe. If U-shaped curved small-radius pipes are attached to the large-radius pipes 1 along their length, then such arrangement of the U-shaped curved pipes 2 enables to change the pumping level. The first outlet end T1 connects to the second inlet end t2, the second outlet end t1 connecting to another first inlet end T2' of an adjacent first pipe 1' of a subsequent pipe unit. The second inlet end t1 connects to the first outlet end T2 through an opening 6 on the first outer surface S, and the second outlet end t1 connects to the another first inlet end T2' through another opening 6' on another first outer surface S'. For example, if each of the curved pipes is installed in the center of the lateral surfaces of the large-radius pipes 1, then the effect of pumping will be absent. And if they are installed at the opposite ends of the large-radius pipes 1, then pumping will be directed to another side.

An optimal operation mode of the claimed gas micropump can be achieved at the following parameter ratios.

a) The relationship of the radius R of the large-radius pipe 1 to the radius r of the U-shaped small-radius pipe 2 is in the value range of R/r=2 to 10000. The greater is the relationship R/r, the greater is the relation of the Knudsen numbers in the U-shaped small-radius pipe 2 and the large-radius pipe 1 and more efficient is the pump. However, very great relationships R/r result in increasing pump dimensions.

b) The relationship of the temperature $T_1$ in the cold zone 3 to the temperature $T_2$ in the hot zone 4 is $T_2/T_1$=1.1 to 3.0. The greater is the relationship $T_2/T_1$, the greater is a temperature gradient along the pipes 1, 2. Velocity of gas thermal sliding along non-uniformly heated walls linearly depends on the temperature gradient, therefore an increase in the relationship $T_2/T_1$ will result to higher efficiency of the pump. However, very high temperatures (a high temperature difference) may result in destruction of the pump structure, e.g., to straightening of the heater or the pipes 1, 2.

c) The relationship of the length L of the large-radius pipe 1 to its radius L/R=2 to 1000; the relationship of the length l of the U-shaped small-radius pipe 2 to its radius r, i.e., l/r=2 to 1000. Lengths of the pipes 1, 2 should be selected so as gas temperatures at their ends are equal to temperatures of the silicon chips; therefore, the pipes should not be too short. It makes no sense if very long pipes are installed in the pump, because it does not result its higher efficiency, but increases the dimensions.

Example 1

When the pump geometric parameters are R/r=5, L/R=5, l/r=5 and the temperature relationship of the hot zone and the cold zone is $T_2/T_1$=1.2, one cascade of the pump in the optimal mode will give a pressure relation at the ends that is equal approximately to 1.07. Thus, it is necessary to use approximately 100 cascades in order to pump out a reservoir with a pressure of 760 Torr to 1 Torr.

Example 2

When the pump geometric parameters are R/r=1000, L/R=1000, l/r=1000 and the temperature relationship of the hot zone and the cold zone is $T_2/T_1$=3.0, one cascade of the pump in the optimal mode will give a pressure relation at the ends that is equal approximately to 1.65. Thus, it is necessary to use approximately 13 cascades in order to pump out a reservoir with a pressure of 760 Torr to 1 Torr.

Example 3

The following device parameter relationships are provided:

$$\frac{R}{r} > 5,$$

$$\frac{A}{r} > 5,$$

$$\frac{L}{R} > 10,$$

$$\frac{l}{r} > 10,$$

$$T_2 > T_1$$

In this Example the device operability is confirmed by calculations, by means of numerically solving the transfer equation during computer simulation of the device.

Unlike the linear classic construction (analogues), the large-radius pipes 1 may be arranged in such a way that the pump occupies a system area intended for it. The large-radius pipes 1 are connected therebetween by U-shaped small-radius pipes 2. In order to increase the pumping rate of the pump, several U-shaped small-radius pipes 2 are connected to each large-radius pipe 1.

The device can be operated as follows.

The pump is hermetically connected to reservoirs or to a device to be pumped out.

A voltage is applied by a current generator to golden films (plates) 5, which results in their heating.

Under the action of the thermal sliding effect that is caused by non-uniform temperature distribution on the pump walls, a gas flows from a reservoir to be pumped out to a receiving reservoir.

The pump operation is controlled by changing a voltage present on the golden films (plates) 5, which results in changing temperatures in the hot zones and pressure relations at the pump ends.

After a required vacuum is achieved, the pump is disconnected from the reservoir or device pumped out, and the current generator is switched off.

The operation of the proposed invention is analyzed by computer simulation of the device. A flow of a gas in the pump is examined by numerically solving the Boltzmann kinetic equation with the corresponding initial and border conditions.

The Boltzmann kinetic equation has the following form:

$$\frac{\partial f}{\partial t} + \xi \frac{\partial f}{\partial x} = I,$$

where: f—velocity distribution function, ξ—gas molecule 3D velocity, t—time, x—3D coordinate, I—collision integral.

The Boltzmann equation can be solved numerically with the use of the random halves method for the physical processes: transfer equation solution and elastic collision calculations.

$$\frac{\partial f}{\partial t} + \xi \frac{\partial f}{\partial x} = 0$$

$$\frac{\partial f}{\partial t} = I$$

The upper equation can be approximated with the use of the explicit conservative scheme with accuracy of the first or second order on non-uniform tetrahedron grids. The lower equation can be solved with the use of the conservative projection method. Its principal idea consists in considering collisions of two molecules with certain velocities, impact parameter and azimuth angle. Velocities after a collision, which do not match a constructed velocity grid in the common case, are calculated with the use of kinematics laws. Values of physical quantities that depend on velocities after a collision are calculated with the use of power interpolation of two neighboring velocity nodes, which interpolation is set so as the laws of matter conservation, momentum conservation and energy conservation are complied with and the thermodynamic equilibrium is not violated. After considering each collision, corresponding changes are introduced into the distribution function.

The suitability of the method for numerically solving the Boltzmann kinetic equation is verified by simulating devices studied experimentally, such as the classic Knudsen pump, as well as by numerically solving tasks, such as search for a thermal conductivity coefficient and a coefficient of viscosity for which theoretical formulae are produced. As to the proposed invention, convergence of the method is established by changing the grid dimensions in the coordinate space and the velocity space.

Figure 2:
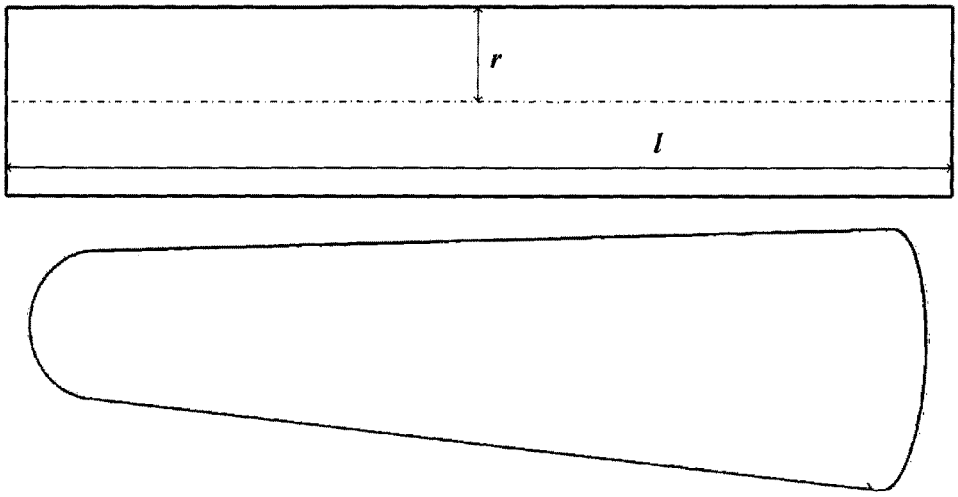
FIG. 2 presents schematic views of a cylindrical pipe used in the classic Knudsen pump and its geometric dimensions.
Figure 3:
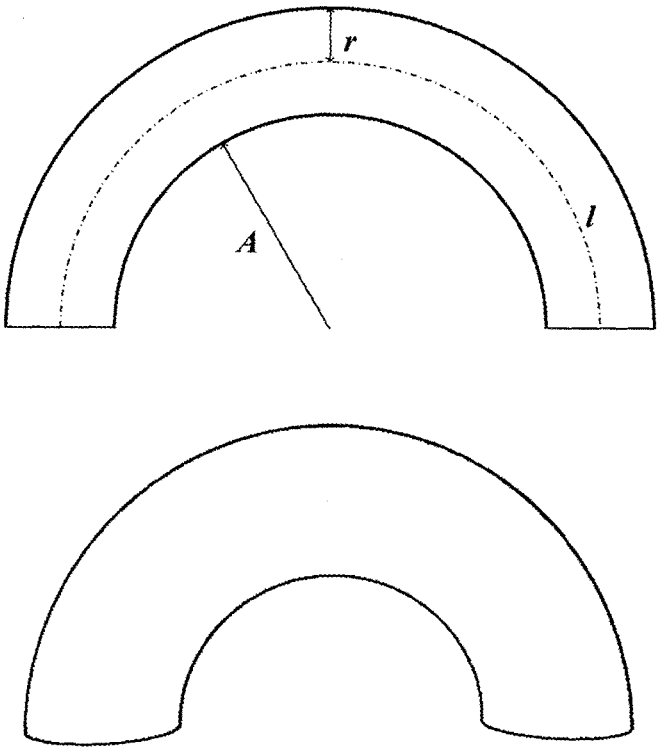
FIG. 3 shows schematic views of a U-shaped pipe used in the proposed invention and its geometric dimensions.

During the first numerical experiment computer models of the straight cylindrical pipe and the U-shaped pipe, as shown in FIGS. 2 and 3, are examined. Dependence of pressure relations at the pipe ends on the Knudsen number Kn is studied. The wall temperature along the pipes is changed linearly, from the value of $T_1$ to $T_2=2T_1$. The relation of the pipe lengths to the radii is selected as l/r=10.

Figure 7:
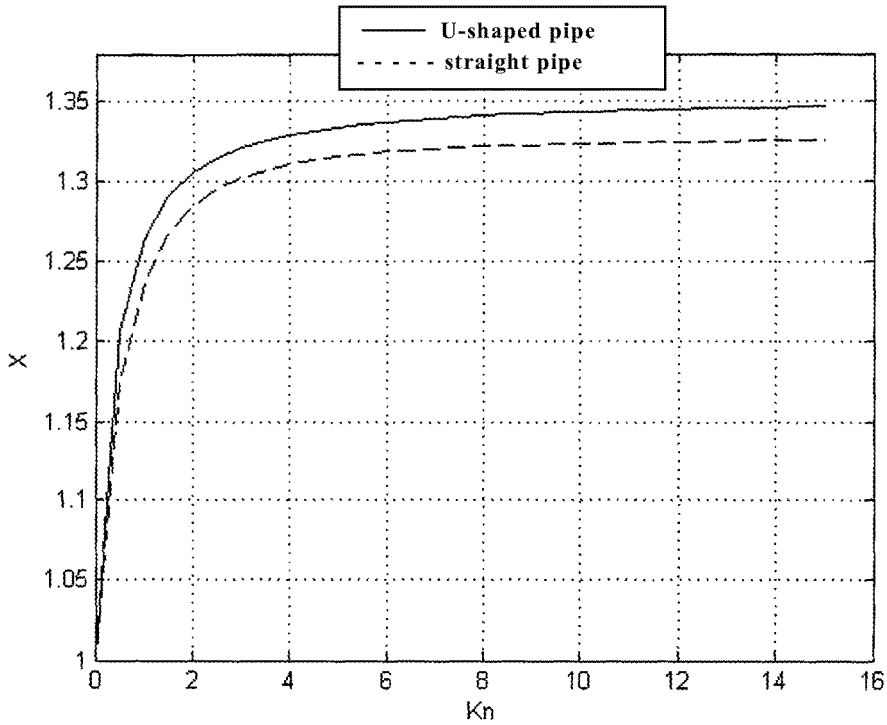
FIG. 7 is a graph illustration, presenting comparative plots of pressure ratios in the ends of the straight pipe and the U-shaped pipe, depending on the Knudsen number.

The geometric parameters and the temperature distribution on the walls of the pipes 1 and 2 are similar. The difference consists in the shape of the pipes 1 and 2 only. FIG. 7 presents the pressure relationships at the pipe ends for the Knudsen number for the straight cylindrical pipe and the U-shaped pipe. FIG. 7 shows that the pressure relationship at the ends of the U-shaped pipe 2 is greater than the pressure relationship at the ends of the straight pipe 1 for all Knudsen numbers taken into consideration. It means that the use of U-shaped pipes 2 enables to increase efficiency of the pump operating on account of the effect of the gas thermal sliding along the non-uniformly heated walls.

Figure 4:
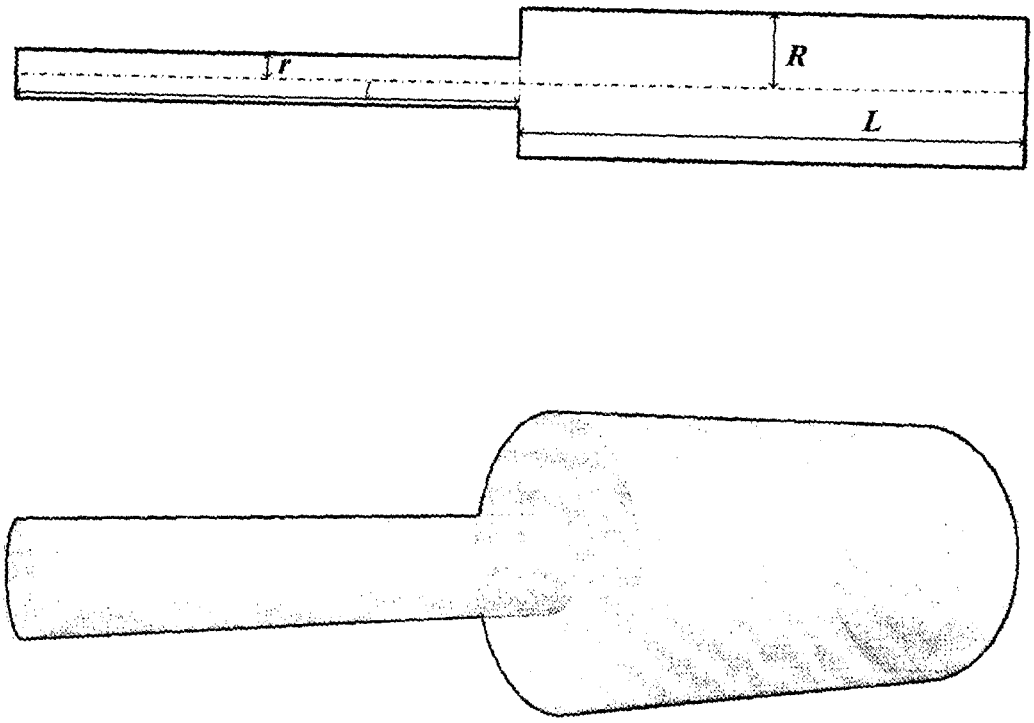
FIG. 4 shows schematic views of the classic Knudsen pump, indicating parameters denoting geometric dimensions, and a 3D model used while numerically solving the Boltzmann kinetic equation.
Figure 5:
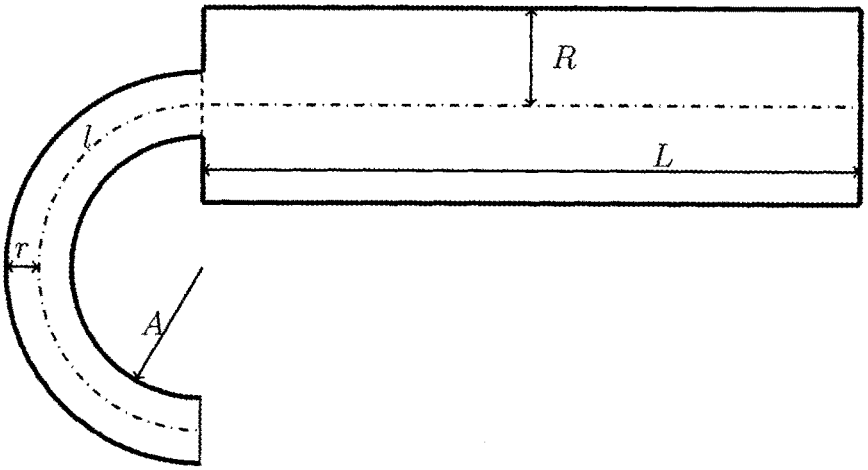
FIG. 5 shows schematic views of one stage of the gas micropump according to the claimed invention, indicating parameters denoting geometric dimensions, and its 3D model.
Figure 5:
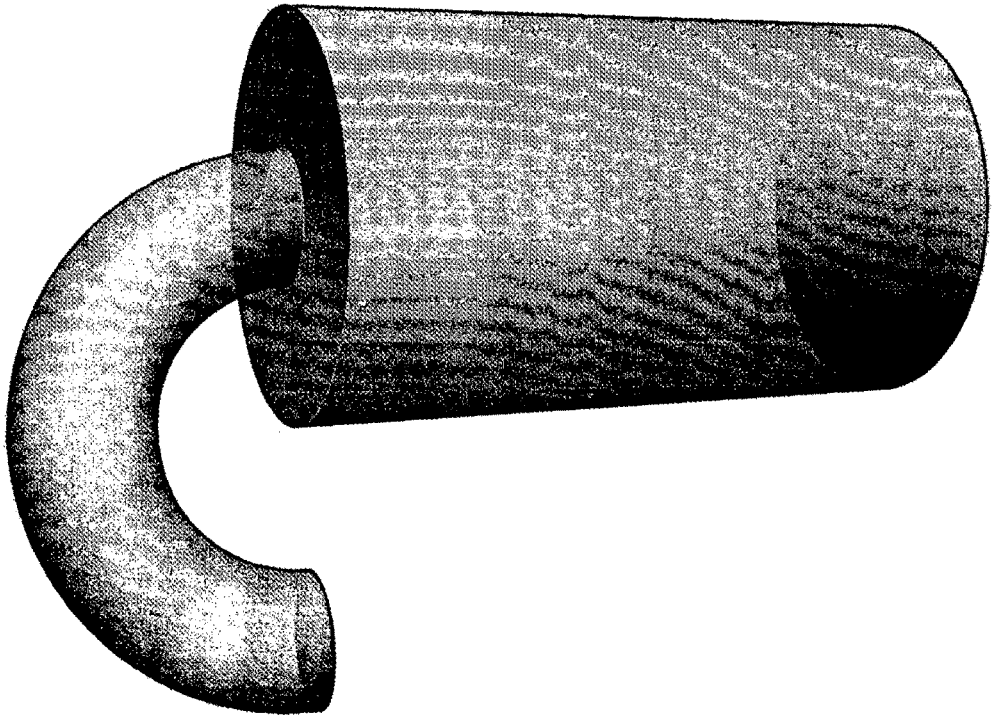

During the second numerical experiment computer models of the classic pump and the proposed invention, as shown in FIGS. 4 and 5, are examined. The following geometric parameters are considered:

A/r=5, L/r=50, l/r=19, R/r=6.

The wall temperatures at the device ends are taken as $T_1$ and at the joint as $T_2=2T_1$.

Figure 8:
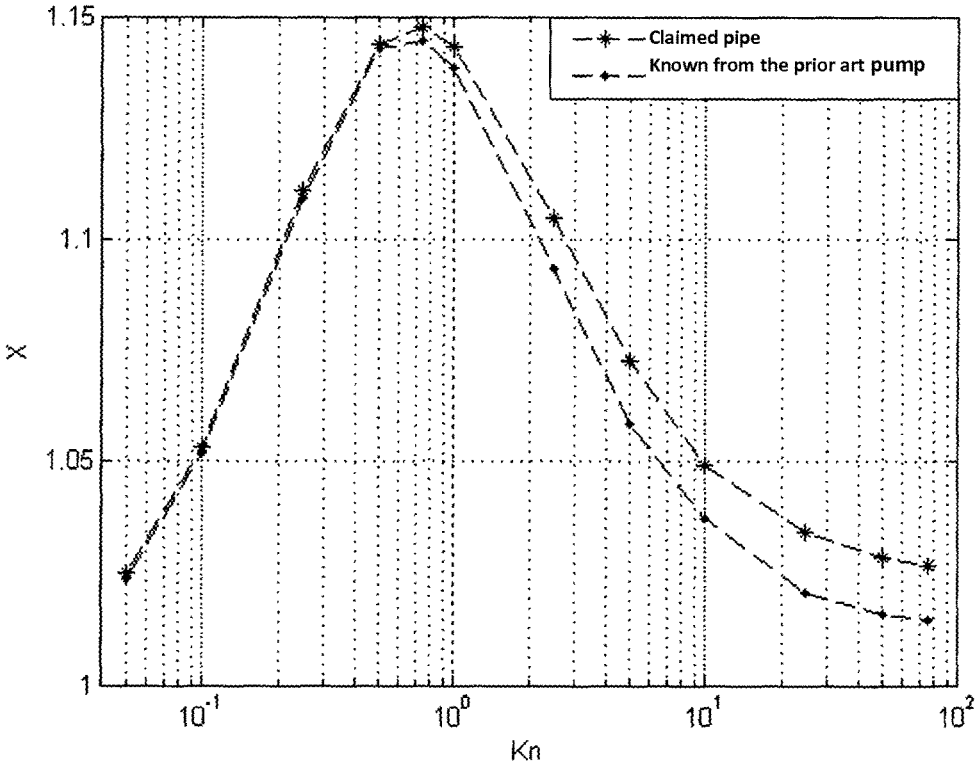
FIG. 8 is a graph illustration, presenting comparative plots of pressure ratios in the ends of the claimed pump and known from the prior art pump, depending on the Knudsen number in the small-radius pipe.
Figure 9:
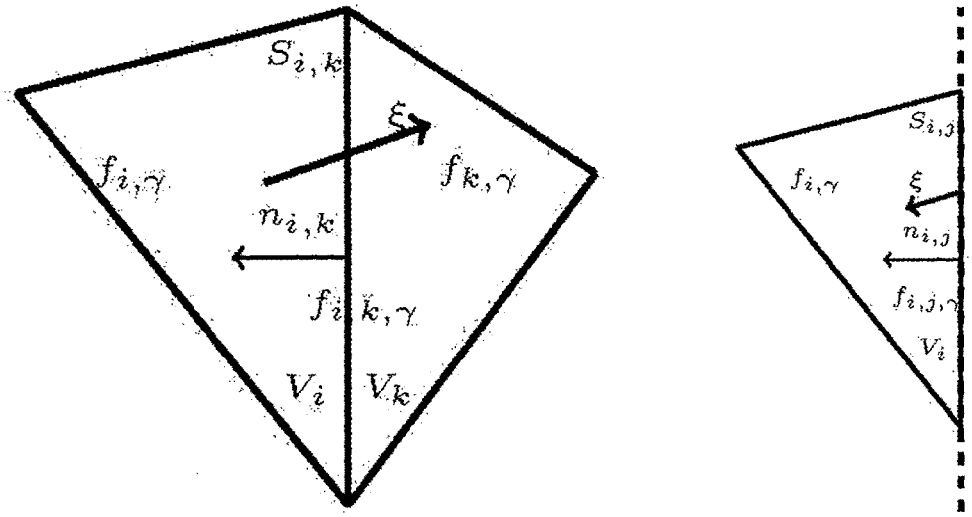
FIG. 9 shows schematic illustrations of diagrams of possible arrangement of tetrahedrons for the purpose of illustrating a numerical solution of the transfer equation during computer simulations of the device.
Figure 10:
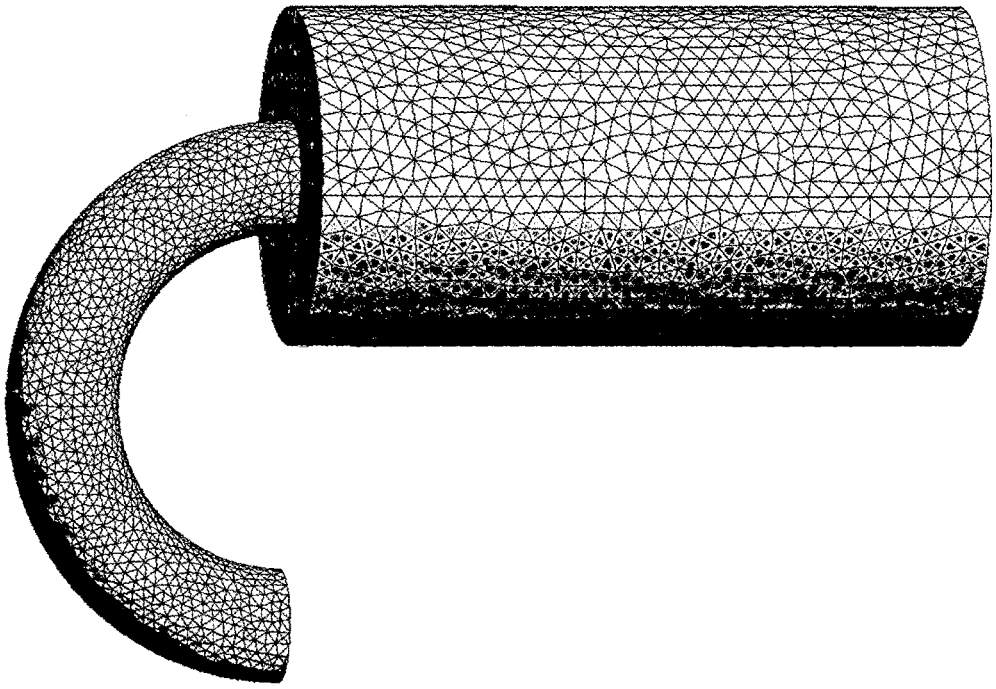
FIG. 10 shows a schematic view, showing a coordinate grid constructed for a computer model of this invention.

FIG. 8 shows a plot of pressure relationship dependence on the Knudsen number at the ends of the classic pump and the proposed device for the small-radius pipes 2. The Knudsen numbers for the large-radius pipes 1 are approximately R/r times less than for the small-radius pipes 2. At small Knudsen numbers the proposed pump maintains efficiency of the classic pump (closest analogous solutions), while at medium and great Knudsen numbers the inventive device provides a pressure relationship for the U-shaped small-radius pipe 2 that is higher than for the known classic pump.

The proposed device is a micropump operating on account of the effect of gas thermal sliding along non-uniformly heated walls and may be introduced into microelectromechanical systems (MEMS). The above-described pump exhibits higher efficiency in comparison to its known analogues. Studies show that the thermal sliding effect is stronger in U-shaped curved pipes 2 than in straight cylindrical pipes. According to this invention, a gas flow is created that goes from the pump inlet to the pump outlet at a higher velocity than in the classic pump (closest analogous solutions), which results in increasing pumping efficiency. U-shaped curved pipes 2 enable to develop more flexible constructions and reduce pump dimensions.

The claimed device has a periodic structure consisting of stages of alternating two types of pipes connected in succession. The pipes 2 of one type have a lesser diameter than the pipes 1 of the other type and are U-shaped. The pipes 1 are straight and cylindrical. Temperature distribution in the micropump is periodical with the same period the structure has, on account of heaters arranged at each second joint of the pipes 1 and 2.

Thus, the proposed technical solution establishes a new association of known and complemented features, which has resulted in a higher technical effect, i.e., increased operation efficiency and reduction in the pump dimensions by changing shapes and relative sizes of the structural members.

INDUSTRIAL APPLICABILITY

The claimed gas micropump may be most favorably used for pumping a gas out of microdevices or in analytical microsystems intended for analyzing small volumes of gases, when mechanical movement of a gas becomes inefficient, as well as may be applicable for filtering gases. The invention may be used in the field of indication and express analysis of air for the presence of substances of various kinds, including poisonous substances, chemically dangerous substances, potent toxic substances, as well as may be related to medical equipment, in particular to apparatuses for artificial pulmonary ventilation. The claimed gas micropump may be used for pumping a gas out of devices which operation requires low vacuum (760 Torr-1 mTorr), high vacuum (1 mTorr-$10^{-7}$ Torr) or ultrahigh vacuum ($10^{-7}$ Torr-$10^{-11}$ Torr). Examples of such devices are mass spectrometers, optical spectrometers, optical electronic devices. Another application for pumps is sampling of a gas from the environment for the purpose of analyzing it in gas detectors and sensors.

We claim:

1. A gas micropump, comprising:

a plurality of continuous cylindrical separating pipe units being connected in series so as to form a continuous passage for flow of gas through the pipe units, each pipe unit being comprised of:

a first pipe, having a first pipe body with a first radius and a first length, said first pipe body having a first outer surface, a first inlet end and a first outlet end, said first pipe being straight and cylindrical; and a second pipe, having a second pipe body with a second radius and a second length, said second pipe body having a second outer surface, a second inlet end in fluid connection to said first outlet end, and a second outlet end, said second pipe being curved in a U-shape and cylindrical, wherein said first radius is larger than said second radius, wherein said first inlet end has a first inlet end temperature, wherein said first outlet end has a first outlet end temperature, wherein said second inlet end has a second inlet end temperature, wherein said second outlet end has a second outlet end temperature, wherein said first outlet end temperature is higher than said first inlet end temperature, wherein said first outlet end connects to said second inlet end, said second outlet end connecting to another first inlet end of an adjacent first pipe of a subsequent pipe unit, wherein said second inlet end connects to said first outlet end through an opening on said first outer surface, wherein a ratio of said first radius to said second radius has a range of 2 to 10000, wherein a ratio of said first radius inlet temperature to said first outlet temperature has a range of 1.1 to 3, and wherein a ratio of said second length to said second radius has a range of 2 to 1000, wherein a pressure relationship between a second pressure differential at said second outlet end from said second inlet end and a first pressure differential at said first outlet from said first inlet end is set by said ratio of said first radius to said second radius, said ratio of said first inlet temperature to said first outlet temperature, and said ratio of said second length to said second radius, said second pressure differential being greater than said first pressure differential.

2. The gas micropump according to claim 1, wherein said second pipe body is comprised of an aerogel material.

3. The gas micropump according to claim 1, further comprising:

a plurality of silicon chips, one chip being placed at said first inlet end, and another chip being placed at said first outlet end, each chip being cylindrical and having a chip radius equal to said second radius.

4. The gas micropump according to claim 1, further comprising:

a plurality of silicon chips, one chip being placed at said first inlet end, and another chip being placed at said first outlet end, each chip having a chip surface comprised of golden film.

5. The gas micropump according to claim 1, wherein said second outlet end connects to said another first inlet end through another opening on another first outer surface.

* * * * *